US007878327B2

(12) United States Patent
Cassina

(10) Patent No.: US 7,878,327 B2
(45) Date of Patent: Feb. 1, 2011

(54) PALLET CONTAINER

(75) Inventor: Virginio Cassina, Gorle (IT)

(73) Assignee: Daviplast-Servicos de Consultoria, Sociedade Unipessoal Ltd., Funchal Madeira (PT)

( * ) Notice: Subject to any disclaimer, the term of this patent is extended or adjusted under 35 U.S.C. 154(b) by 338 days.

(21) Appl. No.: 12/081,279

(22) Filed: Apr. 14, 2008

(65) Prior Publication Data

US 2008/0257230 A1 Oct. 23, 2008

(30) Foreign Application Priority Data

Apr. 18, 2007 (EP) ..... 07398006

(51) Int. Cl.
*B65D 19/00* (2006.01)

(52) U.S. Cl. ..... 206/386; 220/9.4

(58) Field of Classification Search ..... 206/386, 206/599, 600; 108/55.1, 57.33, 51.11, 53.1; 220/485, 9.4, 1.5, 23.87, 23.96; 248/346.02
See application file for complete search history.

(56) References Cited

U.S. PATENT DOCUMENTS

| | | | | |
|---|---|---|---|---|
| 5,058,747 | A * | 10/1991 | Decroix et al. | 206/599 |
| 5,358,137 | A * | 10/1994 | Shuert et al. | 220/485 |
| 5,645,185 | A * | 7/1997 | Cassina | 220/1.5 |
| 6,202,844 | B1 | 3/2001 | Sedlmayr | |
| 6,668,735 | B2 * | 12/2003 | Cassina | 108/57.25 |
| 6,719,164 | B2 * | 4/2004 | Maschio | 220/571 |
| 7,017,499 | B2 | 3/2006 | Schutz | |
| 7,036,662 | B2 * | 5/2006 | Schutz | 206/386 |
| 2005/0092639 | A1 * | 5/2005 | Schutz | 206/386 |
| 2005/0196252 | A1 * | 9/2005 | Schutz | 411/501 |

FOREIGN PATENT DOCUMENTS

| | | | |
|---|---|---|---|
| DE | 202 18 766 | U1 | 2/2003 |
| EP | 0 989 071 | A1 | 3/2000 |
| EP | 1 232 961 | A1 | 8/2002 |
| EP | 1656863 | | 11/2004 |
| EP | 1 568 896 | A2 | 8/2005 |
| EP | 1797801 | | 7/2006 |

OTHER PUBLICATIONS

European Search Report for EP 07 39 8006 dated Jan. 30, 2008.

* cited by examiner

*Primary Examiner*—Mickey Yu
*Assistant Examiner*—Steven A. Reynolds
(74) *Attorney, Agent, or Firm*—Nixon & Vanderhye PC

(57) ABSTRACT

A pallet container for liquids (1) comprises a pallet (10), a metal jacket (3) mounted to the pallet (10) and fastener means (30) for fastening the metal jacket (3) to the pallet (10). The pallet (10) has a base frame (11), two central feet (14, 15), located centrally on either side (12*a*, 12*b*) of the base frame (11) and mounted to the base frame (11), a support member (22) having two opposite end portions (23, 24), each connected to its respective central foot (14, 15) and a platform (25) mounted to the support member (22). The support member (22) has a central portion (26) which supports a corresponding central portion (27) of the platform (25) and the two end portions (23, 24) connected to the base of the two central feet (14, 15).

11 Claims, 8 Drawing Sheets

PALLET CONTAINER

The present invention relates to a pallet container.

FIG. 1 shows a prior art pallet container for transportation and storage of liquids. The pallet container 100 comprises a pallet 101, a cage 102 mounted to the pallet 101 and secured thereto by screw fasteners 107 and an inner container or bag of plastic material 103 mounted to the pallet 101 and surrounded by the cage 102.

The pallet 101 has a base frame 104, a plurality of load-bearing members 105 mounted to the base frame 104, comprising two load-bearing feet, located centrally on either side of the base frame 104, a support member 106 having two opposite end portions mounted to the two central feet and a platform 108 mounted to or lying on the support member 106 (see FIG. 2).

As is known, pallet containers are prone to bending in the central area. Such bending is more apparent during use, as liquid in the inner container has its center of gravity near the central area of the container, but especially during validation tests, in which the container is subjected to an internal hydraulic pressure of 1 bar. This pressure causes such deformations and stresses that the inner container swells and takes a rounded shape.

The central support member 106 has the function of a beam element and dramatically reduces deflection of the platform 108. Furthermore, this central support member 106 is directly attached to the cage 102 and acts as a tie rod during pressure tests and prevents separation of the cage from the central feet (see FIG. 3).

A pallet container as mentioned above is disclosed, for instance, in EP-A-1 232 961.

While these containers reduce deflection of the platform, they still suffer from considerable drawbacks, especially during lifting and handling of the container. It shall be noted that pallet containers are handled using forklifts or lift trucks having container engaging prongs. Whenever the prongs collide with the base frame or with the central load-bearing feet, the base frame, i.e. the intrinsically weaker element of the pallet, may be deformed.

Therefore, a need arises of providing a pallet container in which the impact strength of the central load-bearing feet is increased.

Thus, the object of this invention is to provide a pallet container that has such features as to fulfill the above need, while obviating the drawbacks of prior art.

This object is achieved by a pallet container as defined in claim 1.

Thanks to the particular structure of the central support of the pallet, the pallet container of this invention increases the impact resistance of the central feet.

Further features and advantages of the pallet container of this invention, will be apparent from the following description of one preferred embodiment thereof, which is given by way of illustration and without limitation with reference to the accompanying figures, in which.

Figure 1:
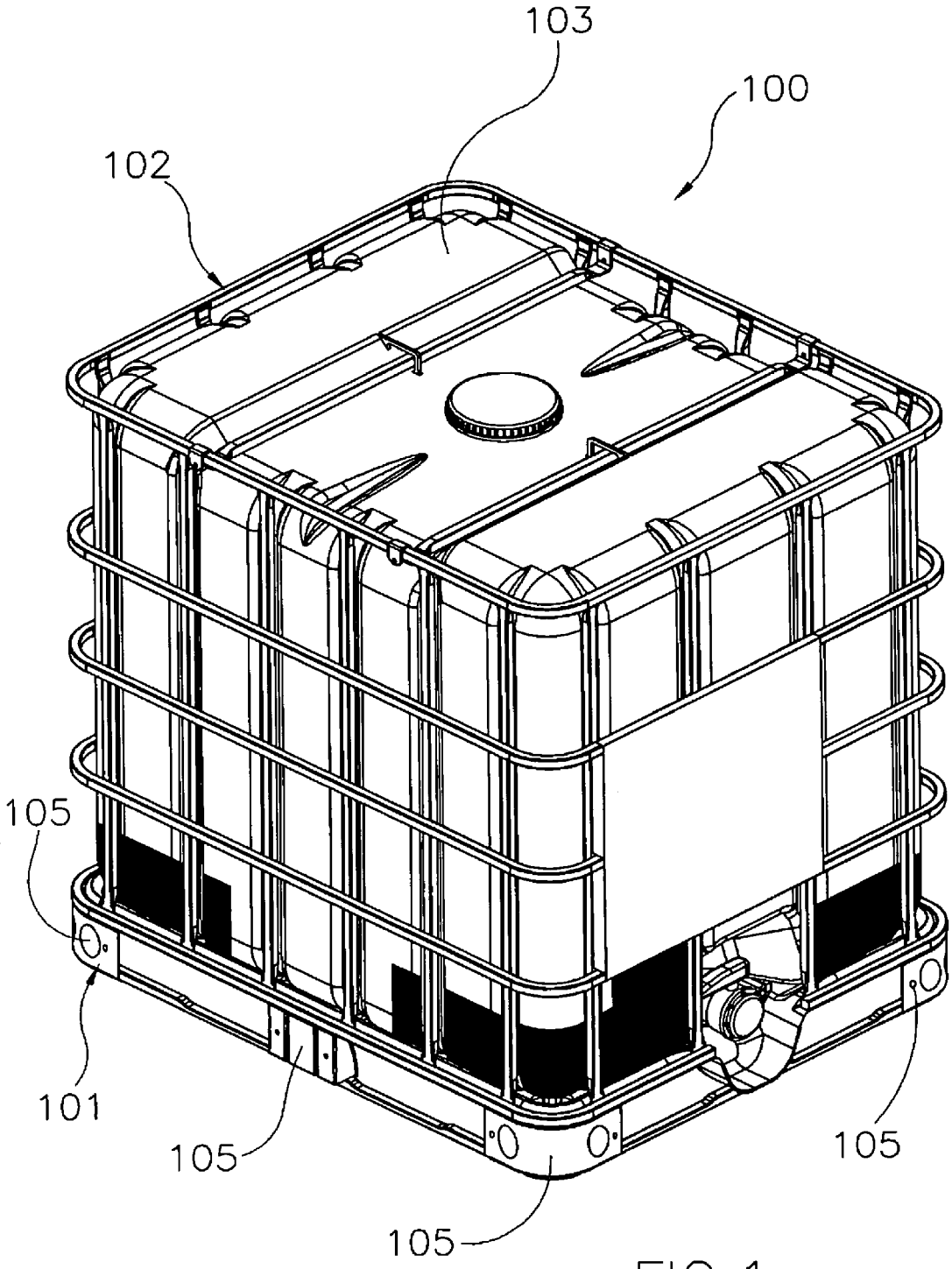
FIG. 1 PRIOR ART
FIG. 1 shows a prior art pallet container.
Figure 2:
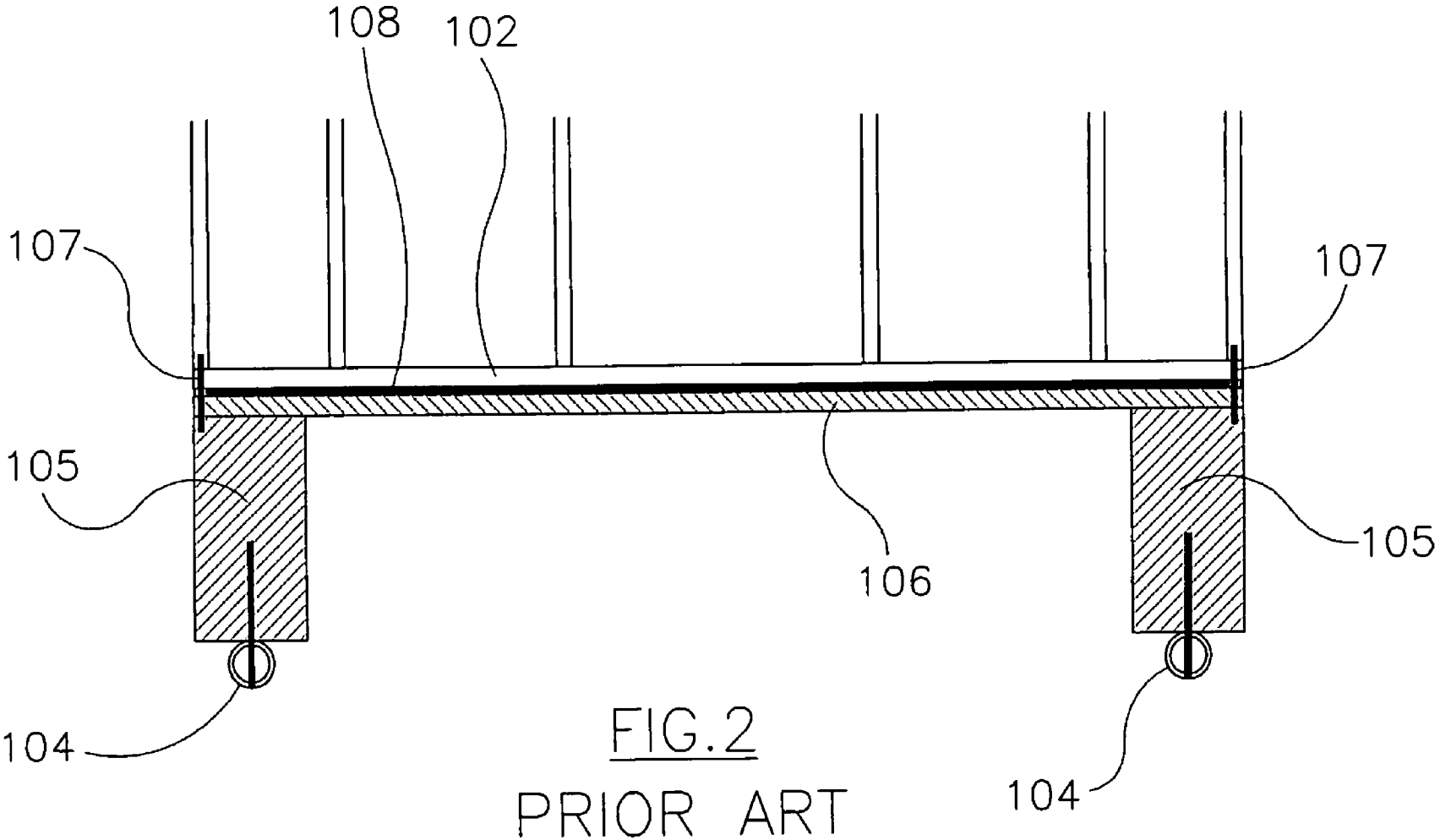
FIG. 2 PRIOR ART
FIG. 2 is a cross sectional view of the pallet container of FIG. 1 in the rest state.
Figure 3:
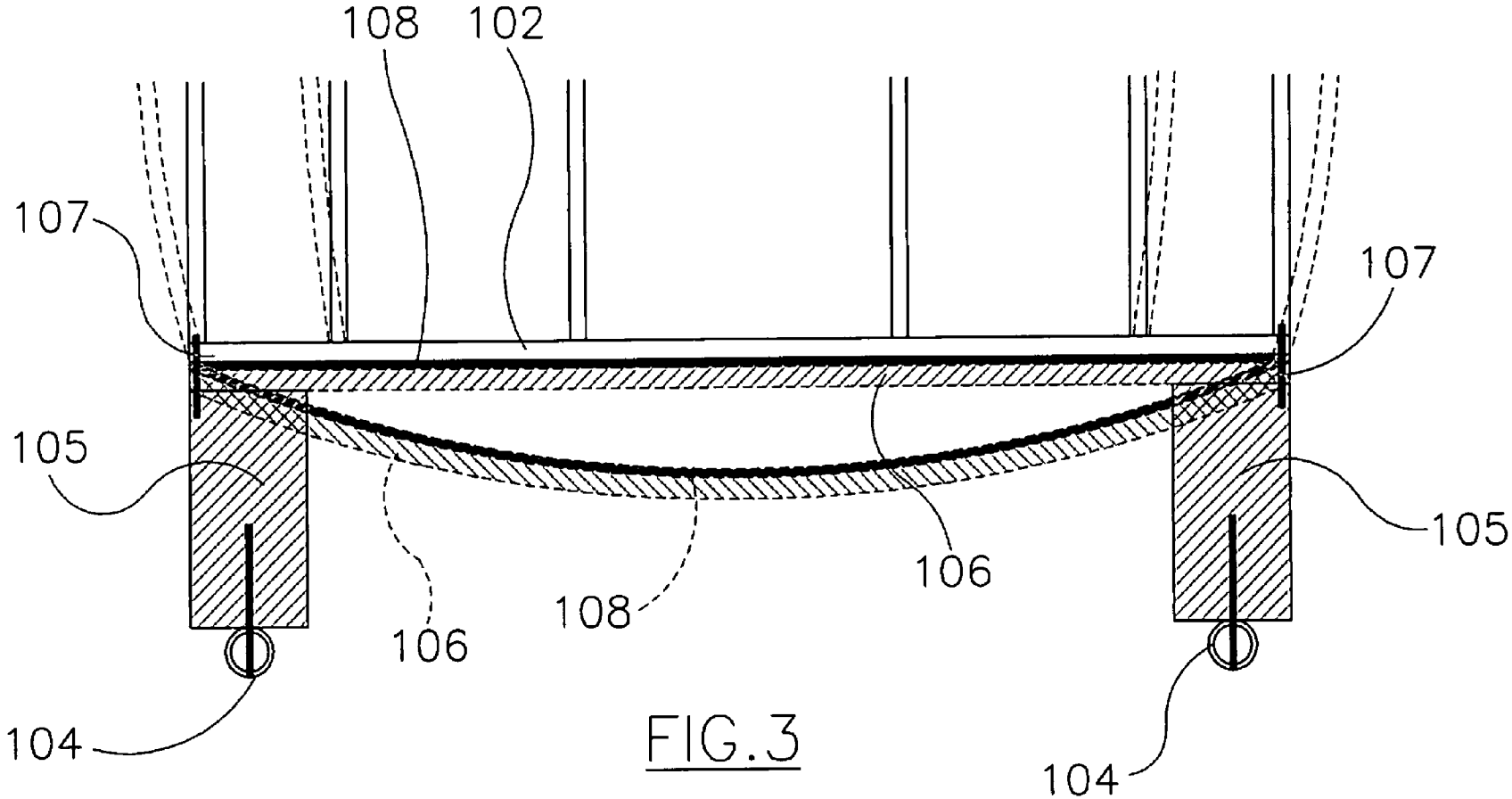
FIG. 3 PRIOR ART
FIG. 3 is a cross sectional view of the pallet of FIG. 2 in the test state.
Figure 4:
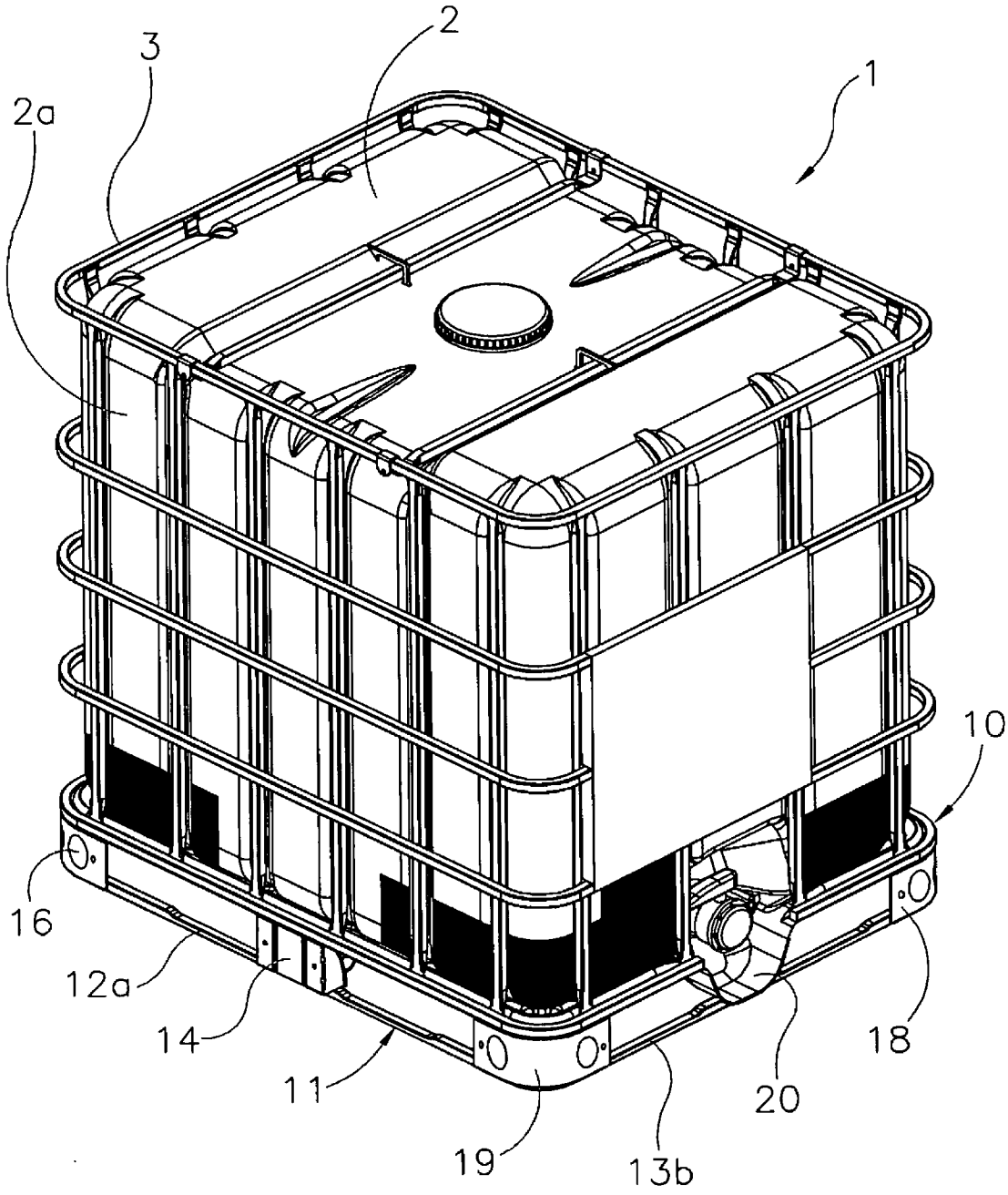
FIG. 4 shows a pallet container according to the present invention.
Figure 5:
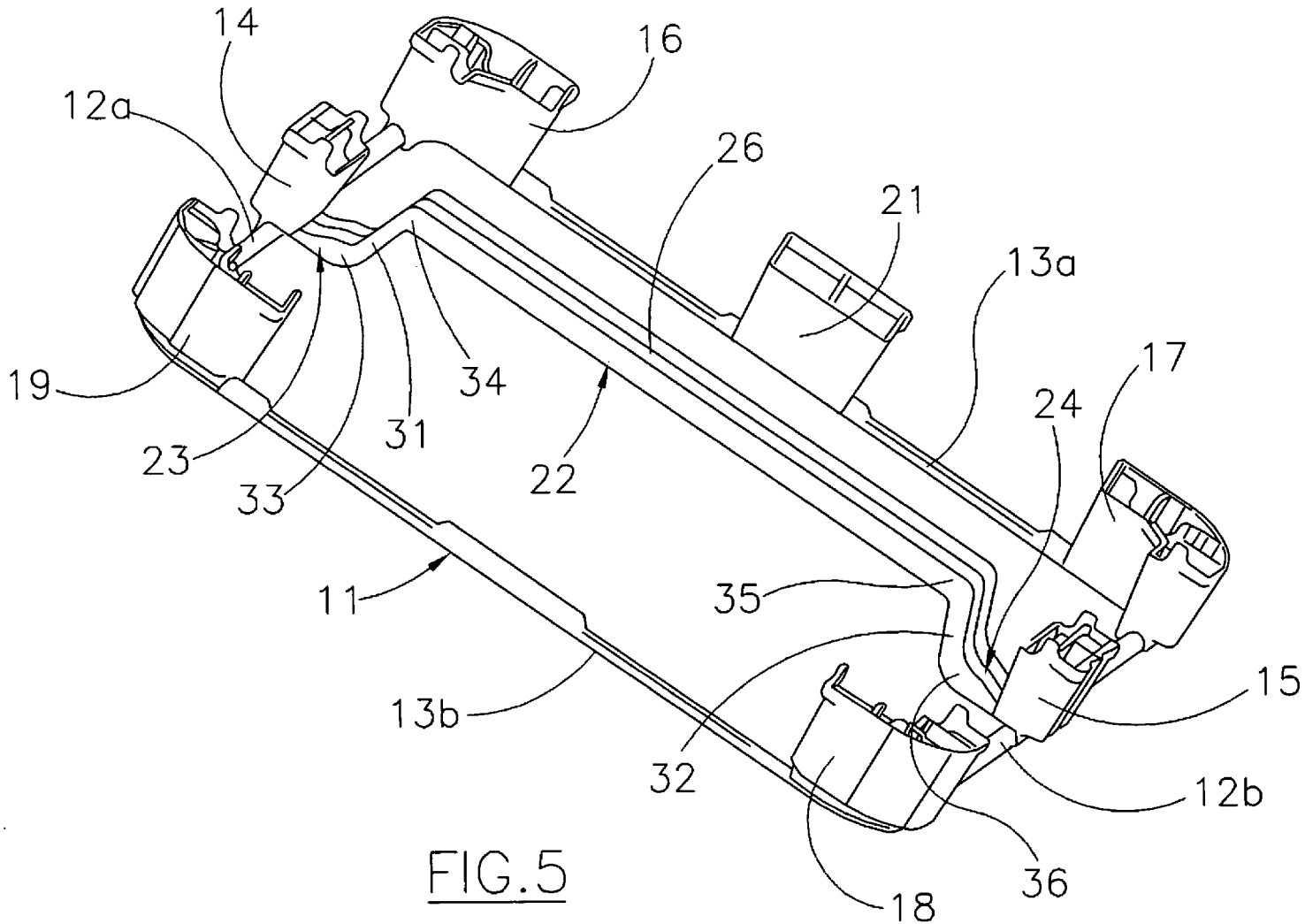
FIG. 5 is a perspective view of the pallet of the container of FIG. 4.

Referring to FIGS. 4 to 8, numeral 1 generally designates a pallet container for liquids according to the present invention.

The pallet container 1 comprises a pallet 10 for supporting an inner container 2 for liquids, a metal jacket 3 mounted to the pallet 10 and fastener means 30 for fastening the metal jacket 3 to the pallet 10.

The pallet 10 comprises a base frame 11 having two pairs of opposite sides 12*a*, 12*b*, 13*a*, 13*b* and load-bearing members mounted to the base frame 11. The load-bearing members may be formed of a plastic or metal material.

The load-bearing members comprise two central feet 14, 15 located centrally on the two opposite sides 12*a*, 12*b* of the base frame 11.

The load-bearing members further comprise corner feet 16, 17, 18, 19 and a central foot 21 and a drainer 20 located at the center of the other two opposite sides 13*a*, 13*b*.

The pallet 10 further comprises a support member 22 having two opposite end portions 23, 24, each connected to its respective central foot 14, 15 and a platform 25 mounted to the metal support member 22. Therefore, the metal jacket 3 is mounted to the platform 25 of the pallet 10. The support member 22 and the platform 25 may be formed of either a plastic or a metal material.

Advantageously, the support member 22 has a central portion 26 which supports a corresponding central portion 27 of the platform 25 and the two end portions 23, 24 connected to the base of the two central feet 14, 15. In other words, the support member 22 is substantially constructed in a bridge shape. This structure of the support member 22 increases the resistance of the central feet 14, 15 to lateral impacts, e.g. by the prongs of the forklifts that are used for lifting and handling the pallet container 1. Thus, the metal jacket 3 is secured to the pallet 10 by fastener means 30, which cooperate with the metal jacket 3, the platform 25 and the central feet 14, 15. According to one embodiment, the fastener means 30 comprise screw fasteners or equivalent fasteners.

In one embodiment, the support member 22 has two opposite connecting portions 31, 32, which join the central portion 26 of the support member 22 to respective end portions 23, 24, to define respective corners 33, 34, 35, 36 around which the connecting portions 31, 32, the central portion 26 and the end portions 23, 24 are articulated.

Advantageously, the two end portions 23, 24 are interposed between the base frame 11 and the bottom surface 14*a*, 15*b* of the two central feet 14, 15 particularly between the top surface of the sides 12*a*, 12*b* of the base frame 11 and the bottom surface 14*a*, 15*b* of the two central feet 14, 15.

According to one embodiment, the two end portions 23, 24 of the support member 22 are secured to the two central feet 14, 15 and the base frame 11 by screw fasteners 140*a* inserted in through holes 141 formed in the frame 11, in the end portions 23, 24 and in the lower part of the central feet 14, 15.

However, the above configuration of the support member 22 provides a lower bending strength, as the load lying on the pallet 10 causes both deformations of the platform 25 and rotations at the corners 33, 34, 35, 36 of the support member 25.

It should be further noted that the platform 25 typically has a thickness of the order of one millimeter and might not ensure sufficient resistance to pressure tests carried out on such containers for validation.

In certain cases, these considerable mechanical stresses might cause separation of the metal jacket 3 from the central feet 14, 15 due to the removal of the fastener means 30 that are pulled out of their seats in the central feet 14, 15.

To obviate this drawback, the container 1 has reinforcement means 40 engaged with the fastener means 30 and the platform 25. The reinforcement means 40 reinforce the upper part of the central feet 14, 15 which, considering the particular structure of the support member 22, is in direct contact with the platform 25.

Advantageously, the reinforcement means 40 are in tensile engagement with the platform 25 and restrict bending of the platform 25, thereby enhancing the bending strength of the platform 25. In other words, the reinforcement means 40 have such construction as to allow use of the platform 25 as a tensile element, to prevent or minimize bending of the platform 25.

Particularly, the reinforcement means 40 are in tensile engagement with the platform 25 to prevent or minimize inclinations of the screw fastener 30 with respect to the axis Y-Y perpendicular to the platform 25, in response to the mechanical stresses of validation pressure tests.

Figure 6:
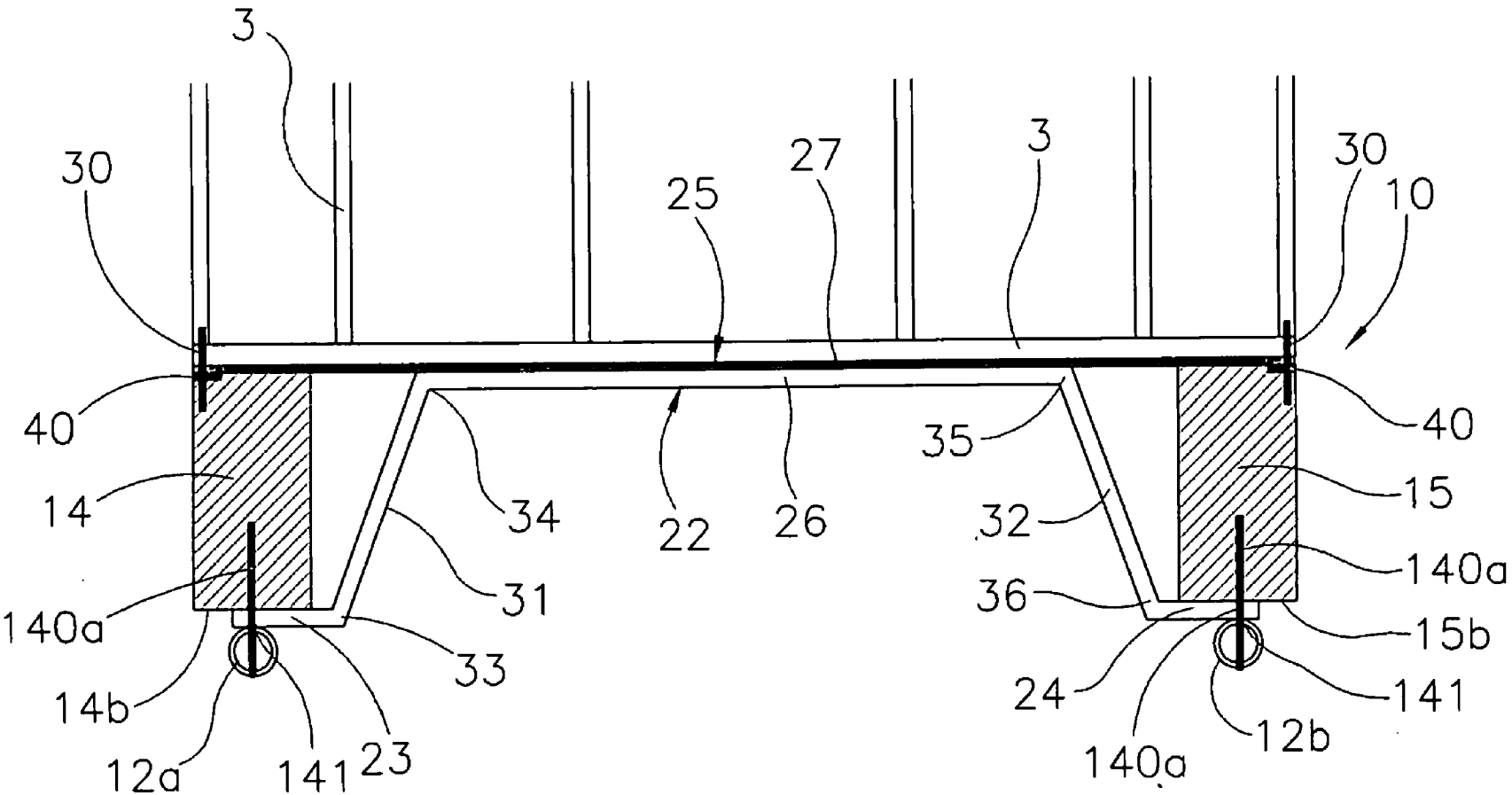
FIG. 6 is a cross sectional view of the pallet container of FIG. 4 in the rest state.
Figure 7:
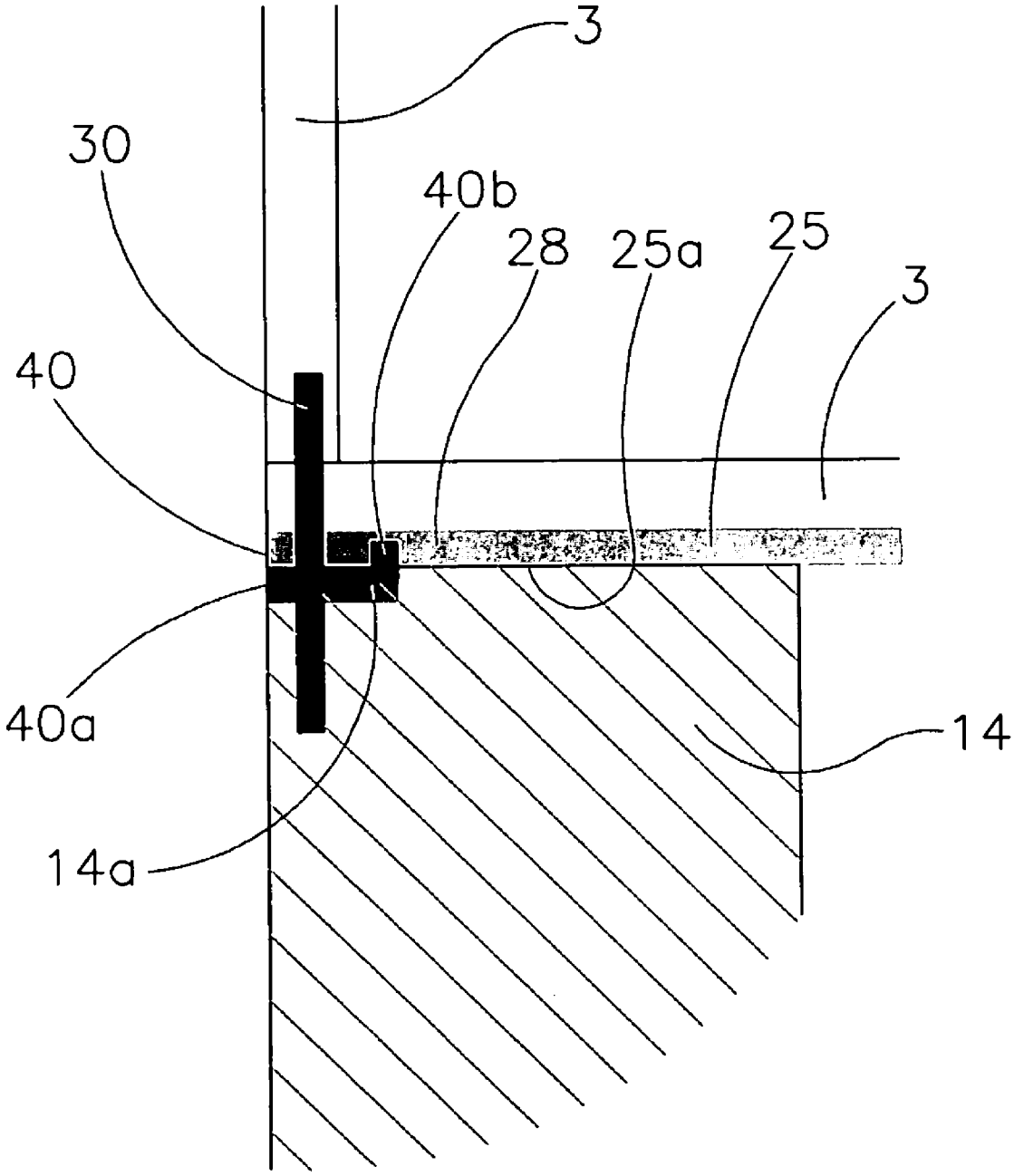
FIG. 7 shows a detail of the pallet of FIG. 6.
Figure 8:
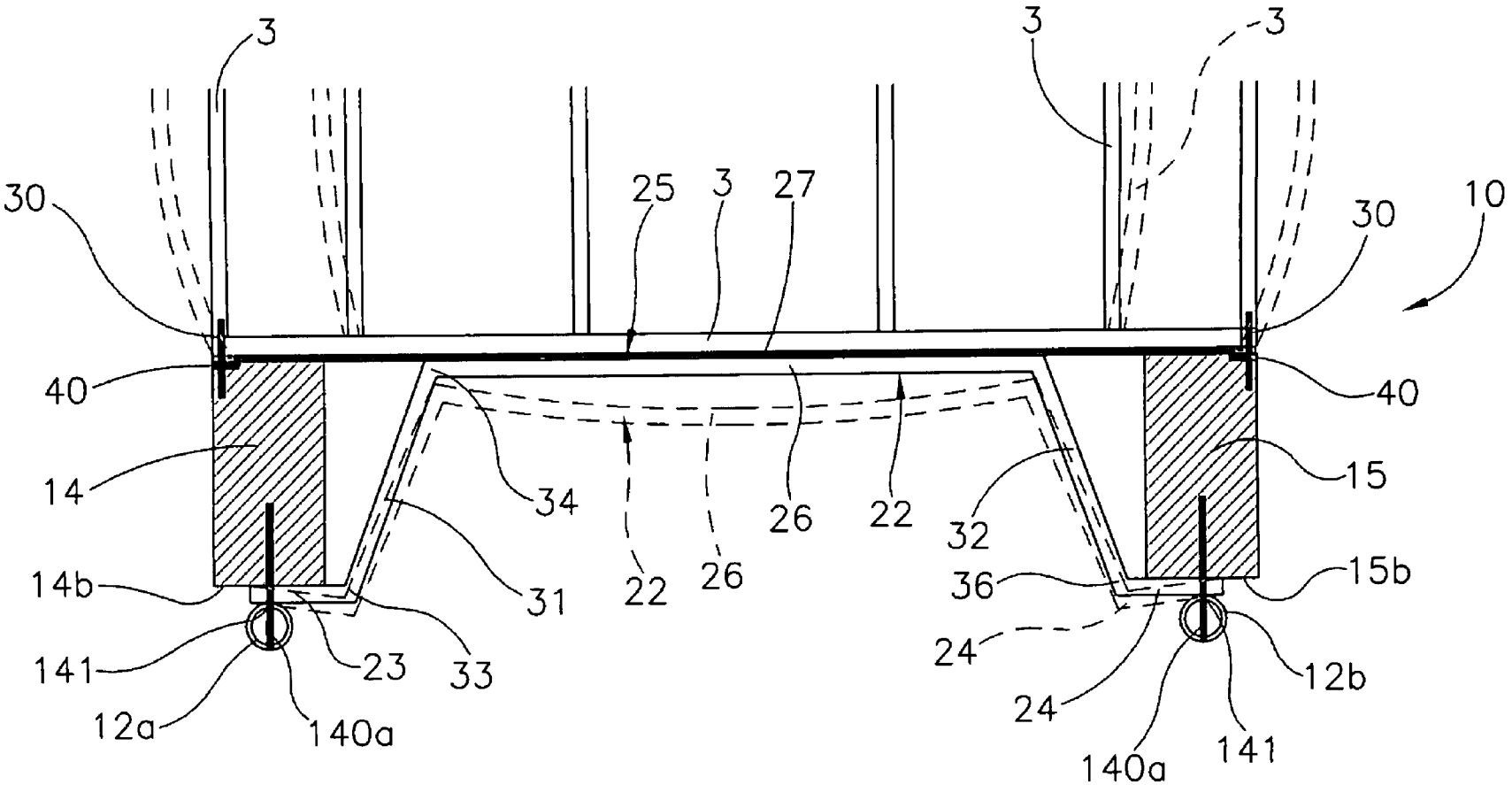
FIG. 8 is a cross sectional view of the pallet of FIG. 4 in the test state.

Therefore, the reinforcement means 40 ensure recovery of the deflection strength of the platform 25 and the resistance required to pass the pressure test. According to one embodiment, the reinforcement means 40 are interposed between the top surface 14*a*, 15*a* of the two central feet 14, 15 and the bottom surface 25*a* of the platform 25 (FIG. 6).

The reinforcement means 40 may comprise a reinforcement member having a shape so as to ensure mechanical coupling with the platform 25, i.e. a lock joint with the platform 25.

According to the embodiment of the figures, the reinforcement means 40 comprise an L-shaped reinforcement member and the platform 25 has a seat 28 for receiving the short side 40*b* of the L-shaped member, having a long side 40*a*.

Alternatively, the reinforcement means 40 may comprise a T- or otherwise shaped reinforcement member, provided that the mechanical coupling or lock joint with the platform 25 is ensured.

Advantageously, the reinforcement means 40 comprise a plate of metal or a metal alloy, e.g. steel. Otherwise, the plate may be formed of a reinforced plastic material, such as a glass-fiber-reinforced material.

Advantageously, the plate 40 has a thickness of the order of a few millimeters wherefore, once it is attached to the metal jacket 3 by the fastener means 30, it prevents the fastener means 40 from being pulled away when considerable mechanical stresses are exerted on the platform 25, thereby preventing any separation of the metal jacket 3 from the central feet 14, 15.

It will be appreciated from the above that the pallet container of the present invention obviates prior art drawbacks. Namely, the particular structure of the central support member, increases impact resistance of the central feet of the pallet container.

Furthermore, when a reinforcement member is provided, it can recover the loss of bending strength caused by the use of the bridge-shaped central support member and prevent the fastener means from being pulled out during container validation tests.

Those skilled in the art will obviously appreciate that a number of changes and variants may be made to the pallet container of the invention as described hereinbefore to meet specific needs, without departure from the scope of the invention, as defined in the following claims.

The invention claimed is:

1. A pallet container for liquids comprising:

a pallet for supporting an inner container for liquids, a metal jacket mounted on said pallet, fastener means for fastening said metal jacket to said pallet, said pallet comprising:

a base frame having two pairs of opposite sides, load-bearing members mounted on said base frame, said load-bearing members comprising two central feet located centrally on two opposite sides of the base frame, a support member having two opposite end portions, each connected to a respective central foot, a platform mounted to said support member, said support member having a central portion supporting a corresponding central portion of said platform and said two end portions connected to the base of said two central feet, and reinforcement means engaged with said fastener means and said platform, wherein said reinforcement means are in tensile engagement with said platform to limit bending of said platform.

2. A pallet container as claimed in claim 1, wherein said support member has two opposite connecting portions, which join the central portion of the support member to respective end portions.

3. A pallet container as claimed in claim 1, wherein said support member is substantially constructed in a bridge shape.

4. A pallet container as claimed in claim 1, wherein said end portions are interposed between said base frame and the bottom surface of said two central feet.

5. A pallet container as claimed in claim 1, wherein said metal jacket is mounted to the platform of said pallet and secured to said pallet by said fastener means, said fastener means cooperating with said metal jacket, said platform and said central feet.

6. A pallet container as claimed in claim 1, wherein said reinforcement means are in tensile engagement with said platform to provide a lock joint with said platform.

7. A pallet container as claimed in claim 1, wherein said reinforcement means are interposed between the top surface of said two central feet and the bottom surface of said platform.

8. A pallet container as claimed in claim 1, wherein said reinforcement means comprise a reinforcement member shaped so as to form a mechanical coupling with said platform.

9. A pallet container as claimed in claim 8, wherein said reinforcement member forms a lock joint with said platform.

10. A pallet container as claimed in claim 1, wherein said reinforcement means comprise an L-shaped reinforcement member, said platform having a seat for receiving the short side of said L shape.

11. A pallet container as claimed in claim 1, comprising an inner container for liquids, formed of plastic material, which is mounted to said pallet and is surrounded by said metal jacket.

* * * * *